US005759645A

United States Patent [19]

Li

[11] Patent Number: 5,759,645

[45] Date of Patent: Jun. 2, 1998

[54] ARTIFICIAL PLANT ASSEMBLY

[76] Inventor: Wing Hon Li, Flat A-D, 5/FL., City Industrial Complex, 116-122 Kwok Shui Rd., Kwai Chung, N.T., Hong Kong

[21] Appl. No.: 751,944

[22] Filed: Nov. 19, 1996

[51] Int. Cl.[6] ..... A41G 1/00

[52] U.S. Cl. ..... 428/20; 428/18; 428/24; 428/27

[58] Field of Search ..... 428/17, 18, 24, 428/27, 20; 156/61

[56] References Cited

U.S. PATENT DOCUMENTS

| | | | |
|---|---|---|---|
| 3,041,766 | 7/1962 | Decamp | 428/24 |
| 5,395,664 | 3/1995 | Thompson | 428/24 |

FOREIGN PATENT DOCUMENTS

| | | | |
|---|---|---|---|
| 1153418 | 5/1969 | United Kingdom | 428/24 |

*Primary Examiner*—Alexander Thomas

*Attorney, Agent, or Firm*—Albert O. Cota

[57] ABSTRACT

An artificial plant assembly (10) consisting of a stationary central stem (12) and a plurality of rotatable fronds (70). The central stem (12) includes a rigid inner core (14) and a molded outer stem (22). Near the lower terminus (26) of the outer stem (22) is a frond stop (30), a bulbous section (48) located above the stop (30), and extending from the upper end (18) and sides is located a plurality of leaves (58). The rotatable frond (70) also has a rigid inner core (72) and a molded outer stem (80). The outer stem (80) has an upper terminus (82), a lower bulbous section (84), and a plurality of leaves (58) that extend from its upper terminus (82) and sides. The lower bulbous section (84) has an open side (86) and an enclosed lower portion (80) having an opening (90). To produce the artificial plant assembly (10) the lower bulbous section (84) is inserted upward through the lower end (16) of the inner core (14) and forced over the frond stop (30). The open side (86) of the frond (70) is then pushed upward against the bulbous section (48). Once inserted, the frond (70) remains rotatably captive within the confines of the stationary central stem (12)

12 Claims, 3 Drawing Sheets

ARTIFICIAL PLANT ASSEMBLY

TECHNICAL FIELD

The invention pertains to the general field of artificial plants and flowers and more particularly to an artificial plant assembly that includes a stationary central stem into which is inserted a rotatable frond that is maintained within the central stem by a frond stop and a pair of interfacing bulbous sections.

BACKGROUND ART

Ever since people have been inhabiting enclosed spaces there has been a desire to include plant life, such as flowers, trees and other flora, into the interior decoration. By including plant life, an occupant of an enclosed space is able to instill a feeling of natural beauty and life consistent with the outdoor environment. For individuals who must remain within an enclosed space for extended periods of time, the addition of plant life provides not only an attractive diversion from normal interior furnishings but also an environment more conducive to better mental health and conditioning.

The greatest deterrent to including plant life in interior decor is that many types of live plants are unable to survive without either direct or partial sunlight or a sufficient amount of water. A plant may be placed in a location to receive as much sunlight possible through a window, but often this is not sufficient and the plant will wither and eventually die.

In response to this problem, many types of artificial plants have been created. These artificial plants have evolved to the point where it is very difficult to determine whether the plant is in fact alive or merely a good reproduction. When artificial plants first became available many people were discouraged because of the obvious un-realistic appearance of the plants. Now most artificial plants are extremely realistic except for certain types or species of plants which are inherently difficult to artificially reproduce.

One of these types of plants includes a stationery central stem having attached thereto a plurality of fronds with outward extending leaves. Due to the methods by which many current artificial plants are designed and assembled, it is obviously apparent that the plant is not living. The most striking appearance is usually the section of the plant where the branches are joined to the central stem. It is difficult to attach the fronds in a manner that is both structurally adequate for support and also realistic-looking. Either the branches are attached in a realistic manner, which often causes them to fall or lean in unnatural positions, or they are insecurely attached clearly exposing the attachment method. Neither option is particularly appealing.

It is therefore readily apparent that some structure and method of creating artificial plants which does not sacrifice the structural integrity of the plant or its realistic appearance is needed.

A search of the prior art did not disclose any patents that read directly on the claims of the instant invention however, the following U.S. patents were considered related:

| U.S. Pat. No. | INVENTOR | ISSUED |
|---|---|---|
| 4,215,163 | Lee | 24 July 1980 |
| 3,829,349 | Hermanson | 13 August 1974 |

-continued

| U.S. Pat. No. | INVENTOR | ISSUED |
|---|---|---|
| 2,826,845 | Warren | 18 March 1958 |

The U.S. Pat. No. 4,215,163 Lee patent discloses an artificial flowers assembly that is made from a plastic stem unitarily molded around a reinforcing wire with integral side petioles, an internal calyx and an internal coupling member. A subassembly of fabric petals, preferably silk printed for viewing where appropriate, is made by loosely mounting the petals on a plastic tubular member. The tubular member is then mounted on the coupling member.

The U.S. Pat. No. 3,829,344 Hermanson patent discloses a collapsible artificial tree arrangement, the arrangement is particularly adapted for Christmas decoration in which simulated branches are freely foldable substantially parallel to the truck, or they may pivot to an erected condition for display. The arrangement includes an elongated trunk core and a plurality of sectional trunk portions disposed there around. Some of the trunk portions have branch holding sockets while others serve as spacing members.

The U.S. Pat. No. 2,826,845 Warren patent discloses an artificial Christmas tree that can be assembled from readily separate members. The invention is designed to closely simulate a natural Christmas tree while providing an artificial tree which may be assembled or disassembled by unskilled persons with a minimum of direction and time. When not in use the tree may be disassembled and subsequently packed and stored in a relatively small container.

For background purposes and as indicative of the art to which the invention relates, reference may be made to the following remaining patents found in the search:

| U.S. PAT. NO. | INVENTOR | ISSUED |
|---|---|---|
| 5,320,884 | Tai, et al | 14 June 1994 |
| 4,585,677 | Hwang, et al | 29 April 1986 |
| 4,386,480 | Horowitz | 7 June 1983 |
| 4,106,233 | Horowitz | 15 August 1978 |
| 3,298,712 | Sears | 23 December 1975 |
| 3,808,082 | Steiber | 30 April 1974 |
| 3,639,196 | Hermanson | 1 February 1972 |
| 3,603,780 | Lu | 26 January 1970 |
| 3,161,559 | Tong | 15 December 1964 |
| 3,131,112 | Abramson | 28 April 1964 |
| 3,115,435 | Abramson | 24 December 1963 |
| 3,007,282 | Galesky | 7 November 1961 |
| 2,984,036 | Adler, Jr. | 16 May 1961 |
| 2,759,285 | Bussert | 21 August 1956 |
| 2,749,638 | Fiedler | 12 June 1956 |
| 2,054,605 | Rogers | 15 September 1936 |
| 1,748,636 | Crocket | 25 February 1930 |
| 1,738,613 | Rice | 10 December 1929 |
| 1,495,695 | Karr | 17 May 1924 |

DISCLOSURE OF THE INVENTION

The artificial plant assembly disclosed herein is designed to be quickly and easily assembled into a realistically appearing plant. In its most basic design configuration, the artificial plant assembly consists of a stationary central stem, at least one rotatable frond, and a means for rotatably attaching and maintaining the rotatable frond within the confines of the stationary central stem.

The stationary central stem is comprised of a substantially rigid inner core and an outer stem molded of plastic around the inner core.

The inner core can be constructed of a metal rod, a plastic rod or a metal tube into which is inserted a metal or plastic rod. The outer stem includes a multiplicity of flora, such as leaves and/or flowers that are integrally and outwardly attached. The outward attachment direction includes at least one leaf or flower extending from the stem's upper terminus and a multiplicity of leaves or flowers extending from opposite sides of the outer stem. The oppositively extending flora are attached on the same plane and are staggered to increase the realism of the central stem.

The rotatable frond is comprised of a substantially rigid inner core and an outer stem that is molded around the inner core. The inner core is preferably made of a metal rod and the outer stem is comprised of a plastic material. To the outer stem is also integrally molded a multiplicity of leaves and/or flowers that extend from the outer stem's upper end and sides. The leaves extending from the sides are on the same plane and are staggered.

The means for rotatably attaching and maintaining the rotatable fronds within the central stem is the primary novel feature of the inventive artificial plant assembly. The attachment means utilizes a frond stop and a bulbous section that are located on the outer stem of the stationary central stem and a complimentary bulbous section that is located on the lower end of the outer stem of the rotatable frond. The bulbous section on the rotatable frond includes an opening that allows it to be inserted over the lower end of the central stem and to be forced over the frond stop. Once the rotatable frond is inserted, the frond stop holds the rotatable frond captive within the confines of the central stem.

As additional rotatable fronds are inserted into the the central stem, the bulbous section of the first or upper frond nests against the bulbous section on the central stem. The subsequent frond bulbous sections inserted into the central stem, nest into the bulbous section located on the previously inserted rotatable frond. When all the fronds are inserted, typically three such fronds, the lower end of the stationary central stem is inserted into a hollow base stem to complete the artificial plant assembly.

To add further realism to the artificial plant assemblies a series of longitudinally spaced circular indentations are included on both the outer stem of the central stem and the rotatable frond. Also, the flora which are preferably made of a resilient material such as silk can be coated with a fire retardant to prevent or reduce incidents of fire.

In view of the above disclosure it is the primary object of the invention to disclose an artificial plant assembly which utilizes a structure and method that allows a plurality of rotatable fronds to be realistically and quickly attached to a stationary central stem.

In addition to the primary object of the invention it is also an object of the invention to produce an artificial plant assembly that:

- can be made of various lengths and diameters,
- can be designed to include any number of rotatable fronds,
- can be intermeshed with a combination of leaf and flower fronds,
- is relatively maintenance free, and
- is cost effective from both manufacturing and consumers points of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

The best mode for carrying out the invention is presented in terms of a preferred embodiment that allows artificial plant assemblies 10 to be realistically simulated, and quickly and easily assembled. The preferred embodiment, as shown in FIGS. 1–7 is comprised of the following three major elements: a stationary central stem 12, a rotatable frond 70 and a hollow base stem 94.

Figure 1:
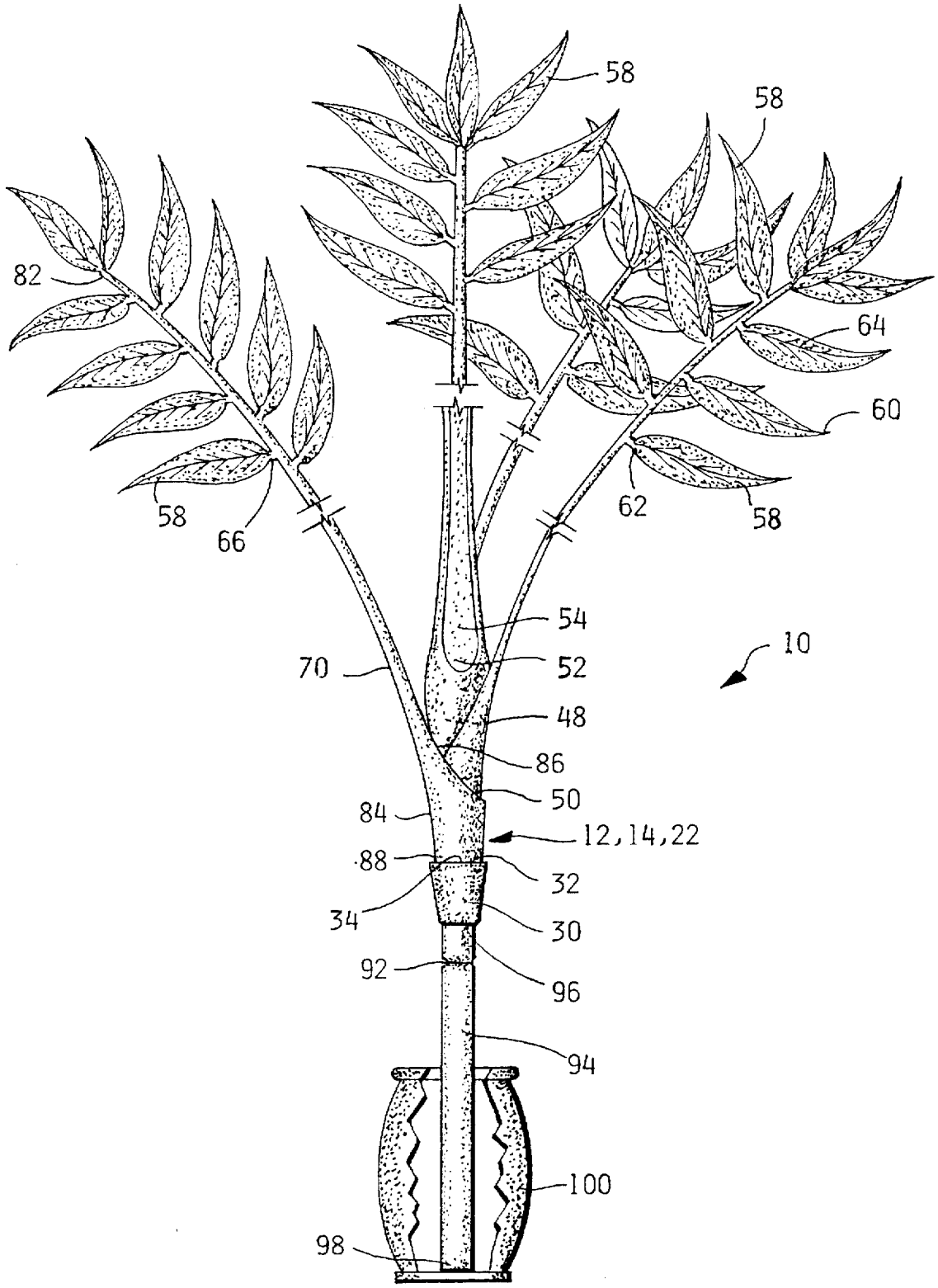
FIG. 1 is an elevational view of an artificial plant assembly that includes a stationary central stem, three rotatable fronds and a hollow base stem inserted into a container.
Figure 2:
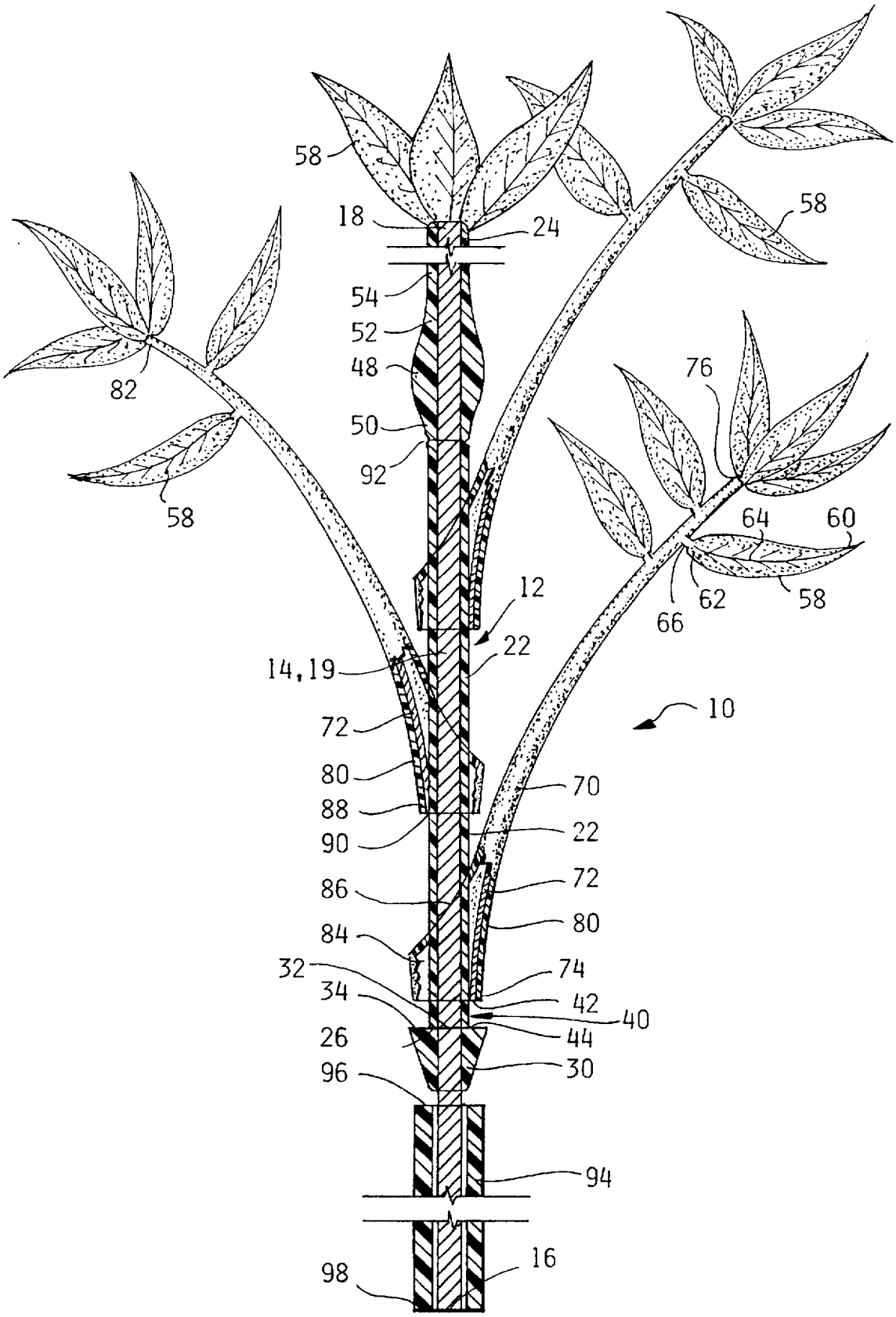
FIG. 2 is a sectional elevational view of the artificial plant assembly with three rotatable fronds and a hollow base stem all partially inserted.
Figure 3:
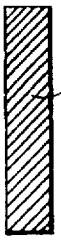
FIG. 3 is a partial sectional view of a rigid inner core constructed of a solid metal rod.
Figure 4:
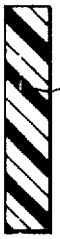
FIG. 4 is a partial sectional view of a rigid inner core constructed of a solid plastic rod.
Figure 5:
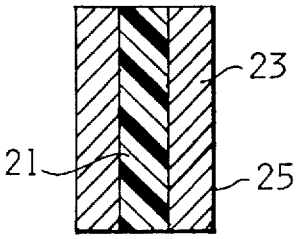
FIG. 5 is a partial sectional view of a rigid inner core constructed of a metal tube.
Figure 6:
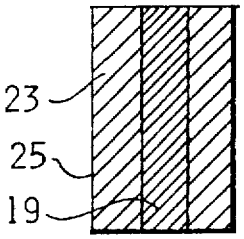
FIG. 6 is a partial 21 sectional view of a rigid inner core constructed of a metal tube into which is inserted either a metal rod (shown) or a plastic rod.

The stationary central stem 12, as shown in FIGS. 1 and 2, is comprised of a substantially rigid inner core 14 and an outer stem 22. The inner core 14 includes a lower end 16, an upper end 18 and can be constructed of a metal rod 19 as shown in FIG. 3, of a plastic rod 21 as shown in FIG. 4, or a metal tube 23 as shown in FIG. 5. Optionally, the inner core 14 may be constructed of an inner core assembly 25 consisting of a lower metal tube 23 into which is inserted a metal rod 19 or a plastic rod 21 with a metal rod 19 preferred as shown in FIG. 6.

The outer stem 22, which is comprised of a plastic material, is molded around the rigid inner core 14. The outer stem 22 includes an upper terminus 24, a lower terminus 26, a frond stop 30, a lower stem section 40, a bulbous section 48 and a multiplicity of leaves 58.

The frond stop 30 extends upward from the lower terminus 26 of the outer stem 22 and terminates with an upper central area 32 as shown best in FIG. 2. From the upper central area 32 extends outward a ledge 34 which functions to stop the lower longitudinal travel of the rotatable frond located at the bottom of the artificial plant assembly 10. Integrally attached to the upper central area 32 of the frond stop 30 is the lower end 44 of a lower stem section 40 which also includes an upper end 42.

The bulbous section 48, as shown in FIGS. 1 and 2, has a lower terminus 50 that is integrally attached to the upper end 42 of the lower stem section 40. From the lower terminus 50 the outwardly extending bulbous section 48 has an upward section 52 that terminates with an inward taper 54 that integrally interfaces with the outer stem 22.

Figure 7:
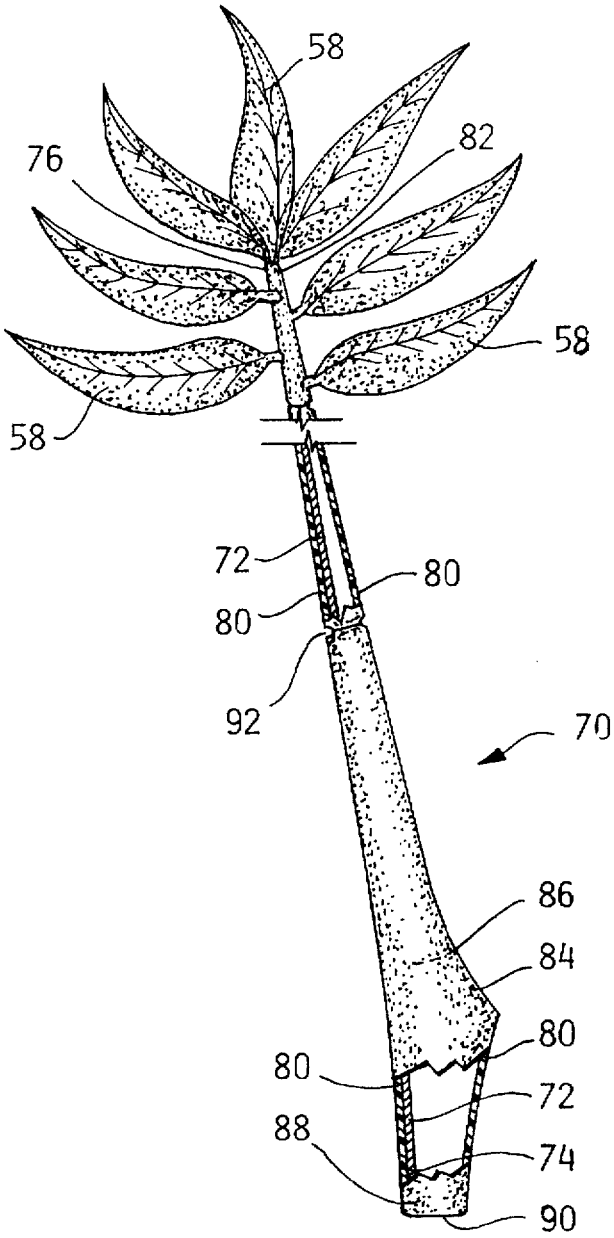
FIG. 7 is an elevational sectional view of a rotatable frond.

Each of the leaves 58, as shown in FIGS. 1, 2 and 7, have an upper end 60, a lower end 62, a midrib 64 and a leaf stalk 66. The stalk 66 extends beyond the lower end 62 of the leaf and is integrally molded to the outer stem 22. The leaves 58 are made of a thin flexible material, such as silk, that simulates the appearance and feel of an actual live leaf. At least one, and preferably three, leaves extend integrally from the upper terminus 24 of the outer stem 22, as shown in FIGS. 1 and 2. Likewise, a multiplicity of the leaves 58 extend from opposite sides of the outer stem 22. The leaves are located in the same plane and preferably staggered, as also shown in FIGS. 1 and 2.

The rotatable frond 70, as shown attached in FIGS. 1–3 and as a separate element in FIG. 7, is also comprised of a substantially rigid inner core 72 and an outer stem 80. The inner core 72 includes a lower end 74, an upper end 76 and can be constructed of a metal rod 19 as shown in FIG. 3 or a plastic rod as shown in FIG. 4.

The outer stem 80, which is also comprised of a plastic material is molded around the rigid inner core 72 and includes an upper terminus 82 and a lower bulbous section 84. The bulbous section 84 as best shown in FIG. 7, has an open side 86 and an enclosed lower portion 88 having an opening 90 with a diameter that is slightly smaller than the outward extending ledge 34 located on the front stop 30.

To add realism to the artificial plant assembly 10, the outer stem 22 of the central stem 12 and the outer stem 80 of the rotatable frond 70 include a series of longitudinally spaced circular indentations 92. The indentations 92, as shown best in FIG. 2 add to the stem's perceived realism.

To form the artificial plant assembly 10, the lower bulbous section 84 of at least one of the rotatable fronds 70 is inserted upwards through the lower end 16 of the rigid stationary inner core 14. During the insertion, the opening 90 on the hollow bulbous section 84 is forced over the ledge 34 located on the front stop 30. To conclude the insertion process the open side 86 of the hollow bulbous section 84 is pushed further upward to allow the inner surfaces of the hollow bulbous section 84 to interface with the exterior surfaces of the bulbous section 52 located on the stationary central stem 12. After insertion, the opening 90 returns to its original dimension which prevents the hollow bulbous section 84 from being retracted downward over the frond stop 30. Thus, the rotatable frond 70 remains captive within the confines of the stationary central stem 12.

In the above description only one rotatable frond 70 is discussed for simplicity of disclosure. However, in the preferred artificial plant assembly 10, at least two and preferably three rotatable fronds 70 are inserted into the stationary central stem 12. When a second and subsequent rotatable fronds are used, the lower bulbous section 84 of the first inserted rotatable frond 70 is pushed upward against the bulbous section 48 on the stationary central stem 12. The second inserted rotatable frond 70 is then inserted over the frond stop 30, as previously described, with the opening of the hollow bulbous section 84 interfacing with the lower exterior surfaces of the first inserted bulbous section 84. Likewise a third bulbous section 84 may thereafter be inserted in a similar manner.

To complete the artificial plant assembly 10, a hollow base stem 94 is utilized. The stem 94 has an upper end 96 and a lower end 98. Into the upper end 96 is inserted the lower end 16 of the rigid, stationary inner core 14. The lower end 98 of the base stem is then placed into a holder or vase for displaying the assembly. To add realism to the base stem, it may also include a series of longitudinally spaced circular indentations 92.

While the invention has been described in complete detail and pictorially shown in the accompanying drawings it is not to be limited to such details, since many changes and modifications may be made in the invention without departing from the spirit and scope thereof. For example, the outer stem 22 and the rotatable frond 70, including the leaves 58, can be made of plastic, cloth, wood fibers or a light metal. Additionally, in lieu of leaves 58 flowers may be used to make the artificial plant assembly 10. Hence, it is described to cover any and all modifications and forms which may come within the language and scope of the appended claims.

I claim:

1. An artificial plant assembly comprising:

a) a stationary central stem comprising a substantially rigid inner core and an outer stem molded around said inner core, wherein a multiplicity of flora is integrally attached to and extend outward from said outer stem, b) at least one rotatable frond comprising a substantially rigid inner core and an outer stem molded around said inner core, wherein a multiplicity of flora is integrally attached to and extends outward from said outer stem, and c) means for rotatable attaching and maintaining said rotatable frond within the confines of said stationary central stem, wherein said means comprises:

a) said outer stem of said stationary central stem comprising:

(1) an upper terminus and a lower terminus, (2) a frond stop extending upward from the lower terminus and terminating with an upper central area having an outward extending ledge, (3) a lower stem section having an upper end and a lower end, wherein the lower end is integrally attached to the upper central area of said frond stop, (4) a bulbous section having a lower terminus integrally attached to the upper end of said lower stem section, and an upward section that terminates with an inward taper which interfaces with said outer stem, (b) said outer stem of said rotatable frond comprising an upper terminus and a lower bulbous section having an open side and an enclosed lower portion having an opening with a diameter smaller than the outward extending ledge of said stem stop, wherein to form said artificial plant assembly, the bulbous section of said rotatable frond is inserted upward through the lower end of said stationary inner core with the opening on said lower bulbous section forced over the ledge on said frond stop which then allows the open side of said lower bulbous section to interface with the bulbous section of said stationary central stem, whereupon after insertion, the lower bulbous section cannot be retracted downward over said frond stop.

2. An artificial plant assembly comprising:

a) a stationary central stem comprising:

(1) a substantially rigid inner core having a lower end and an upper end, (2) an outer stem molded around said inner core, wherein said outer stem comprises:

(a) a upper terminus and a lower terminus, (b) a frond stop extending upward from the lower terminus and terminating with an upper central area having an outward extending ledge, (c) a lower stem section having an upper end and a lower end, wherein the lower end is integrally attached to the upper central area of said frond stop, (d) a bulbous section having a lower terminus integrally attached to the upper end of said lower stem section, and an upward section that terminates with an inward taper which interfaces with said outer stem, (e) a leaf having an upper end, a lower end, a midrib and a leaf stalk which extends beyond the lower end of said leaf, wherein at least one of said leaves extends integrally from the upper terminus of said outer stem and a multiplicity of said leaves extend from opposite sides of said outer stem.

b) a rotatable frond comprising:

(1) a substantially rigid inner core having a lower end and an upper end, (2) an outer stem molded around said rigid inner core, with said outer stem having an upper terminus and a lower bulbous section having an open side and an enclosed lower portion having an opening with a diameter slightly smaller than the outward extending ledge of said stem stop, and (3) a leaf having an upper end, a lower end a midrib and a leaf stalk which extends beyond the lower end of said leaf, wherein at least one of said leaves extends integrally from the upper terminus of said outer stem and a multiplicity of said leaves extend integrally from opposite sides of said outer stem, wherein to form said artificial plant assembly, the hollow bulbous section of at least one of said rotatable fronds is inserted upwards through the lower end of said stationary inner core with the opening on said hollow bulbous section forced over the ledge on said frond stop which then allows the open side of said hollow bulbous section to interface with the bulbous section of said stationary central stem, whereupon after insertion, the hollow bulbous section cannot be retracted downward over said frond stop.

3. The assembly as specified in claim 2 wherein said rigid inner core is comprised of a metal rod.

4. The assembly as specified in claim 2 wherein said rigid inner core is comprised of a plastic rod.

5. The assembly as specified in claim 2 wherein said rigid inner core is comprised of a metal tube.

6. The assembly as specified in claim 2 wherein said rigid inner core is comprised of an inner core assembly consisting of a lower metal tube into which is inserted a metal rod or a plastic rod.

7. The assembly as specified in claim 2 wherein said outer stem is comprised of a plastic material.

8. The assembly as specified in claim 2 wherein said leaves are made of a thin flexible material that simulates an actual leaf.

9. The assembly as specified in claim 8 wherein said flexible material is silk.

10. The assembly as specified in claim 8 wherein said multiplicity of leaves extending from opposite sides of said outer stem are on the same plane and are staggered.

11. The assembly as specified in claim 2 wherein said outer stems further comprise a series of longitudinally spaced circular indentations which add to the stems perceived realism.

12. The assembly as specified in claim 2 further comprising a hollow base stem having an upper end and a lower end, where into the upper end is inserted the lower end of said substantially rigid inner core and the lower end of said base stem is placed into a container for displaying said artificial plant assembly.

* * * * *